US010280657B2

(12) United States Patent
Griesedieck et al.

(10) Patent No.: US 10,280,657 B2
(45) Date of Patent: May 7, 2019

(54) SECURITY TAGS FOR SHIPPING CONTAINERS

(71) Applicant: MarkEd Ventures, LLC, St. Louis, MO (US)

(72) Inventors: Edward J. Griesedieck, St. Louis, MO (US); Mark E. Belew, St. Louis, MO (US)

(73) Assignee: MARKED VENTURES, LLC, St. Louis, MO (US)

( * ) Notice: Subject to any disclaimer, the term of this patent is extended or adjusted under 35 U.S.C. 154(b) by 3 days.

(21) Appl. No.: 15/658,075

(22) Filed: Jul. 24, 2017

(65) Prior Publication Data

US 2019/0024423 A1 Jan. 24, 2019

(51) Int. Cl.

| | |
|---|---|
| ***B65D 88/12*** | (2006.01) |
| ***E05B 83/14*** | (2014.01) |
| ***G09F 3/03*** | (2006.01) |
| ***B65D 90/00*** | (2006.01) |
| ***B65D 90/22*** | (2006.01) |
| *B65D 90/54* | (2006.01) |

(52) U.S. Cl.

CPC ..... *E05B 83/14* (2013.01); *B65D 88/12* (2013.01); *B65D 90/008* (2013.01); *B65D 90/22* (2013.01); *G09F 3/0347* (2013.01)

(58) Field of Classification Search

CPC ..... B65D 88/12; B65D 90/008; B65D 90/22; E05B 83/14; G09F 3/0347

USPC ..... 220/1.5; 70/50, 54, 55, 56, 439, 440

See application file for complete search history.

(56) References Cited

U.S. PATENT DOCUMENTS

| | | | |
|---|---|---|---|
| 5,005,883 | A | 4/1991 | Guiler |
| 5,010,748 | A | 4/1991 | Derman |

(Continued)

FOREIGN PATENT DOCUMENTS

| | | | |
|---|---|---|---|
| KR | 20-0432678 | Y1 | 12/2006 |
| KR | 10-2008-0033605 | A | 4/2008 |
| WO | WO-2016038402 | A1 | 3/2016 |

OTHER PUBLICATIONS

Hurliman Casters Corp., "Container seal lock," http://hurlimancasters.com/manufacturer-in-india-container-seal-lock.html (1 page).

(Continued)

*Primary Examiner* — J. Gregory Pickett
*Assistant Examiner* — Niki M Eloshway
(74) *Attorney, Agent, or Firm* — Harness, Dickey & Pierce, P.L.C.

(57) ABSTRACT

A shipping container includes walls, one or more doors, a locking device and a security device. At least one door is movable between an open position and a closed position. The locking device is configured to secure the at least one door in its closed positioned. The locking device defines an opening and includes a first fastener and a second fastener. At least one of the fasteners is attached to the door. The security device is insertable through the opening of the locking device. The security device includes a first wing substantially covering the first fastener and a second wing substantially covering the second fastener to substantially prevent access to the first fastener and the second fastener when the security device is inserted through the opening of the locking device. Other example shipping containers, security devices, etc. are also disclosed.

20 Claims, 6 Drawing Sheets

(56) References Cited

U.S. PATENT DOCUMENTS 5,118,149 A * 6/1992 Emmons ..... E05B 13/002 292/205
5,127,687 A * 7/1992 Guiler ..... F16B 41/005 292/327
5,857,721 A 1/1999 Liroff
6,331,022 B1 12/2001 Liroff
6,357,266 B1 * 3/2002 Van Buren ..... E05B 83/10 70/211
6,464,269 B1 * 10/2002 Wilhelm ..... E05B 39/00 292/281
6,581,419 B1 * 6/2003 Strodtman ..... E05B 13/002 292/205
7,210,316 B1 * 5/2007 Falconer ..... E05B 13/002 292/218
7,225,649 B2 * 6/2007 Wyers ..... B60D 1/60 70/258
7,825,811 B2 11/2010 Chan et al.
2005/0144991 A1 * 7/2005 Bravo ..... E05B 13/002 70/56
2005/0156438 A1 7/2005 Ching
2005/0252257 A1 * 11/2005 Woods ..... E05B 67/04 70/33
2007/0007776 A1 * 1/2007 Beard ..... E05B 39/02 292/327
2007/0024064 A1 2/2007 Carter
2008/0029529 A1 * 2/2008 Ruhl ..... B65D 90/008 220/890
2010/0038366 A1 2/2010 Yin et al.
2010/0283578 A1 11/2010 Henderson
2013/0233035 A1 9/2013 Mulllis et al.
2017/0328095 A1 * 11/2017 Ko ..... E05B 63/185

OTHER PUBLICATIONS

Transport Security, Inc., "The Enforcer," http://www.transportsecurity.com/uploads/1/0/2/0/10201511/enforcer_seal_guard_lock_5900__5950_v1.1.pdf (1 page).
International Search Report and Written Opinion of PCT Application No. PCT/US/2018/043031 filed Jul. 20, 2018 which claims priority to the instant application, dated Oct. 30, 2018, 13 pages.

* cited by examiner

SECURITY TAGS FOR SHIPPING CONTAINERS

FIELD

The present disclosure generally relates to security tags for shipping containers.

BACKGROUND

This section provides background information related to the present disclosure which is not necessarily prior art.

Shipping containers are containers used to ship and store cargo. Sometimes, the containers include door locking mechanisms to secure one or more doors of the containers. In such examples, the door locking mechanism commonly includes two bolts for securing the mechanism to the door(s). Sometimes, a tag, a seal, or a metal tie is used with the mechanism to discourage users from interfering with the mechanism. Commonly, the tag, the seal or the metal tie may be inserted through an opening in the mechanism to identify whether the doors have been opened. For example, a user may identify the doors of the containers may have been fraudulently and/or prematurely opened if the tag, the seal or the metal tie has been removed.

SUMMARY

This section provides a general summary of the disclosure, and is not a comprehensive disclosure of its full scope or all of its features.

According to one aspect of the present disclosure, a shipping container for storing cargo is disclosed. The shipping container includes a plurality of walls defining a cargo storing area, one or more doors coupled to at least one of the plurality of walls, a locking device and a security device. At least one door of the one or more doors is movable between an open position exposing the cargo storing area and a closed position. The locking device is configured to secure the at least one door in its closed positioned. The locking device defines an opening and includes a first fastener and a second fastener. At least one of the first fastener and the second fastener is attached to the at least one door. The security device is insertable through the opening of the locking device. The security device includes a first wing substantially covering the first fastener and a second wing substantially covering the second fastener to substantially prevent access to the first fastener and the second fastener when the security device is inserted through the opening of the locking device.

According to another aspect of the present disclosure, a security device for a shipping container is disclosed. The shipping container includes a plurality of walls defining a cargo storing area, one or more doors coupled to at least one of the plurality of walls, at least one door of the one or more doors movable between an open position exposing the cargo storing area and a closed position, and a locking device configured to secure said at least one door in its closed positioned. The locking device defines an opening and includes a first fastener and a second fastener. At least one of the first fastener and the second fastener is attached to the at least one door. The security device is adapted for placement in the opening of the locking device. The security device defined by a first end, a second end opposing the first end, and a neck between the first end and the end. The security device comprises a first wing including the first end and a portion of the neck and a second wing including the second end and a portion of the neck. The first wing and the second wing are connectable. The first wing and the second wing are adapted to substantially cover the first fastener and the second fastener, respectively, to prevent access to the first fastener and the second fastener when the security device is placed in the opening of the locking device.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts and/or features throughout the several views of the drawings.

DETAILED DESCRIPTION

Figure 1:
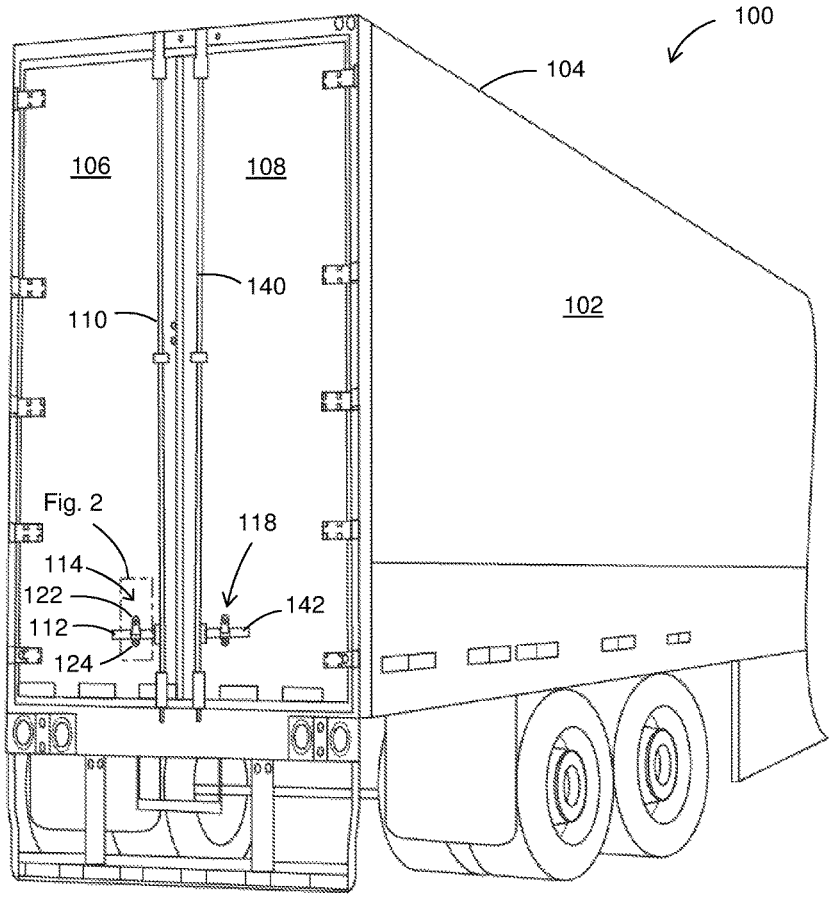
FIG. 1 is a perspective view of a portion of a shipping container including a locking device according to one example embodiment of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, shapes and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

A shipping container for storing cargo according to one example embodiment of the present disclosure is illustrated in FIG. 1 and indicated generally by reference number 100. As shown in FIG. 1, the shipping container 100 includes walls (e.g., a side wall 102, a top wall 104, etc.) defining a cargo storing area, two doors 106, 108 coupled to the walls, a locking device 114, and a security device 116 (see FIG. 4). One or both doors 106, 108 are movable between an open position exposing the cargo storing area and a closed position. The locking device 114 secures the door 106 in its closed positioned, as shown in FIG. 1. As shown in FIGS. 1-4, the locking device 114 includes fasteners 122, 124 both attached to the door 106. The locking device 114 defines an opening 126, as shown best in FIGS. 2-4.

Figure 4:
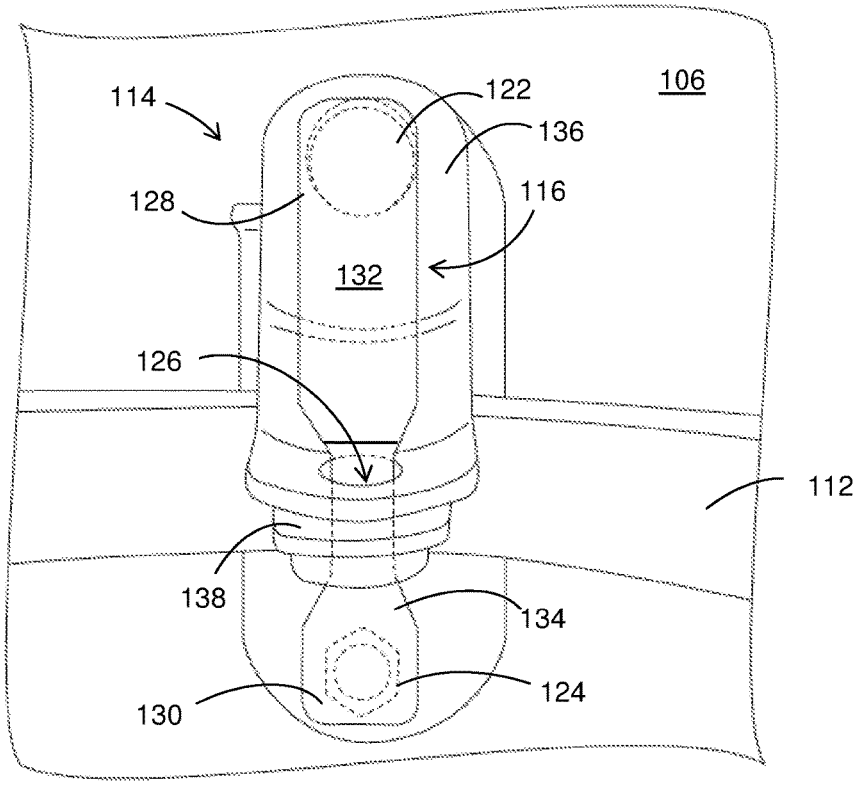
FIG. 4 is the enlarged front view of the locking device of FIG. 2, where fasteners of the locking device are substantially covered by a security device.

The security device 116 may be installed in the locking device 114. For example, and as shown in FIG. 4, the security device 116 may be insertable through the opening 126 of the locking device 114. In such examples, the security device 116 includes wings 128, 130 substantially covering the fasteners 122, 124, respectively. In this manner, the security device 116 substantially prevents access to the fasteners 122, 124 when positioned in the opening 126 of the locking device 116. By preventing access to the fasteners 122, 124, theft of, tampering with, etc. cargo stored in the cargo storing area may be substantially reduced (and in some cases eliminated) through use of the security device 116 (and/or another security device disclosed herein) compared to other conventional systems and/or devices.

For example, cargo stored in a shipping container may be stolen by various individuals between when the shipping container leaves its shipping location and arrives at one or more destinations. Sometimes, a substantial amount of the cargo may be stolen during this time without the receiving party knowing. For example, about 838 cargo thefts were recorded in the United States in 2016. This is roughly 70 cargo thefts per month in the United States alone. The large amount of theft may equate to nearly $172.9 million in losses for the receiving parties, the shipping parties, etc. This equates to an average loss of about $206,837 per shipment.

To discourage such theft, some shipping containers include a door locking mechanism having one or more fasteners (e.g., bolts, etc.). A conventional tag may then be coupled to the door locking mechanism and used to indicate (at times) if the door has been opened (or otherwise tampered with) and to discourage unauthorized users from interfering with the door locking mechanism. However, and as recognized by the subject inventors, a thief may be able to manipulate (e.g., move, etc.) the conventional tag and access the fasteners of the door locking mechanism. Once accessed, the thief may manipulate, destroy, remove, etc. the fasteners and/or the door locking mechanism without properly opening the door locking mechanism. As a result, the thief can open the door(s) and gain access to cargo in the shipping container.

Sometimes, the thief can remove the fasteners (e.g., by drilling out the fasteners, unscrewing the fasteners, etc.) and the door locking mechanism, steal the cargo, and then replace, reinstall, etc. the fasteners and the door locking mechanism without tampering with, destroying, etc. the conventional tag. As such, an extended period of time (e.g., weeks, month, etc.) may pass before the receiving party realizes that some or all of their cargo has been stolen. This realization may occur, for example, when the cargo is inspected, inventoried, etc. and/or when a bill is received.

The subject inventors recognized that the security device 116 (and/or other example security devices disclosed herein) may be employed to substantially cover fasteners and/or other components of a locking device to prevent a thief from accessing the fasteners and/or other components, as explained herein. Thus, not only can the security device 116 prevent access to the fasteners of the door locking mechanism, the security device 116 can also identify when a door of the shipping container has been unlawfully opened. As a result, theft of, tampering with, etc. cargo may be substantially reduced (and in some cases eliminated) compared to other conventional systems and/or devices.

As explained above, when installed to the locking device 114, the security device 116 substantially covers the fasteners 122, 124. For example, the wings 128, 130 may be sized to cover about 95% of the fasteners 122, 124, respectively, more or less than 95% of the fasteners 122, 124, and/or another suitable percentage to ensure the fasteners 122, 124 cannot be tampered with. In some embodiments, and as shown in FIG. 4, the wings 128, 130 completely cover the fasteners 122, 124, respectively. In such examples, the wings 128, 130 may have the same or a larger surface area, diameter, circumference, width, height, etc. as the fasteners 122, 124. For example, if the wing 128 and the fastener 122 have similar shapes, the wing 128 may have the same or a larger surface area as the fastener 122 to ensure the wing 128 completely covers the fastener 122. As such, the security device 116 may inhibit the fasteners 122, 124 from being accessed (e.g., from a drill, etc.).

In some embodiments, the security device 116 may be substantially rigid. For example, when a force is applied to the security device 116, the security device 116 may substantially resist deformation to ensure the fasteners 122, 124 are not exposed. Additionally and/or alternatively, the security device 116 may be at least somewhat brittle such that the security device 116 may break when a force is applied thereto. This may indicate to the cargo's owner that someone has tampered with the security device 116 and possibly the cargo in the shipping container 100.

In other embodiments, the security device 116 may be flexible, but not enough to expose the fasteners 122, 124. In such examples, the flexibility of the security device 116 may depend on the size, shape, etc. of the wings 128, 130 relative to the fasteners 122, 124. For example, if the wings 128, 130 are larger than the fasteners 122, 124, the security device 116 may have more flexibility than other examples where the wings 128, 130 are the same size or slightly smaller than the fasteners 122, 124.

In the illustrated embodiment, the security device 116 includes a two-piece construction. For example, and as shown in FIG. 4, the security device 116 is formed of two members 132, 134. In other embodiments, and as further explained below, the security device 116 (and/or any other security device disclosed herein) may be a one-piece construction, a three piece construction, etc.

In the example of FIGS. 1-4, the member 134 may be inserted through the opening 126, and then the members 132, 134 may be coupled together. For example, one member (e.g., the member 132) may be screwed into, clipped on, forcibly inserted into, etc. the other member (e.g., the member 134). In some embodiments, one member may include an opening for receiving a portion of the other member to couple the members 132, 134 together. Additionally and/or alternatively, the members 132, 134 may be secured together using a key, etc. if desired.

In the particular example of FIG. 4, the member 132 substantially corresponds to the wing 128, and the member 134 includes the wing 130. Thus, in this example, the member 132 is smaller than the member 134. In other examples, the member 134 may substantially correspond to the wing 130, the member 132 may be larger than the wing 128, the members 132, 134 may be substantially equal in size, etc.

In some embodiments, once the members 132, 134 are coupled together, they cannot be separated without destroying the security device 116. In other words, a user cannot disassemble the security device 116 once the members 132, 134 are attached together. As such, the security device 116 may be considered a single use security device. This configuration may assist in discouraging individuals from tampering with the security device 116. For example, this configuration requires a user to destroy, damage, etc. the security device 116 to access the fasteners 122, 124 (and possibly the cargo storing area, etc.). In other embodiments, the members 132, 134 of the security device 116 may be separated and used again (if desirable). In such examples, the security device 116 may be considered a multi-use security device.

As explained above, the door 106 is coupled to the wall 102. For example, the door 106 (and/or other doors disclosed herein) may be coupled to the wall 102 via one or more mechanical fasteners such as hinges, screws, bolts, etc. In some examples, the door 106 may be removable from the wall 102 and/or movable relative to the wall 102.

Figure 2:
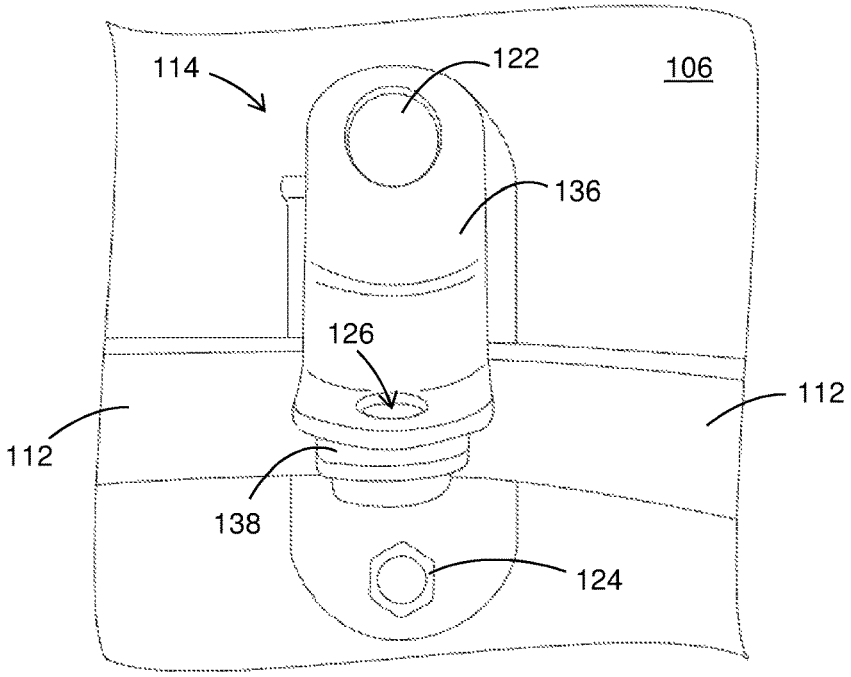
FIG. 2 is the enlarged front view of the locking device of FIG. 1.
Figure 3:
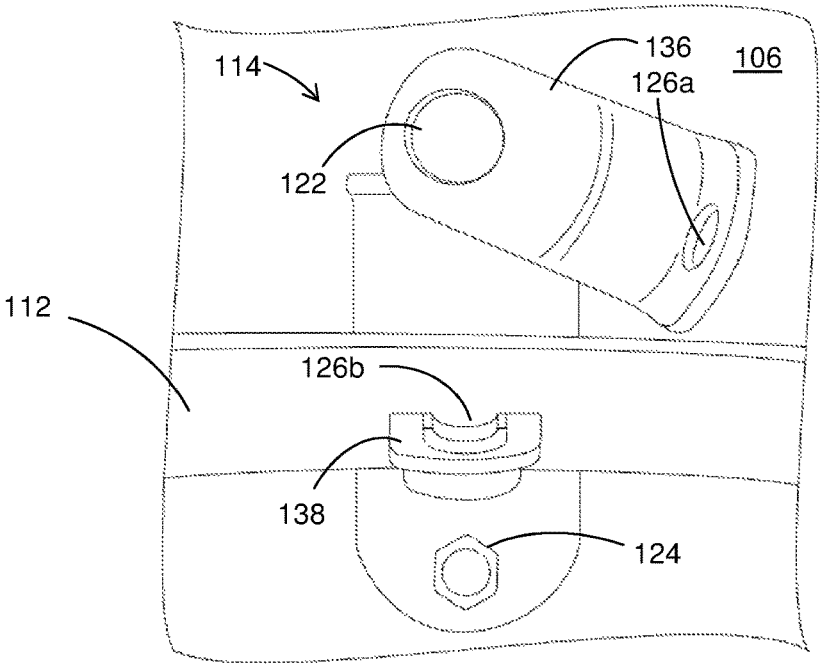
FIG. 3 is the enlarged front view of the locking device of FIG. 2, where a portion of the locking device is rotated.

As shown in FIGS. 2-4, the locking device 114 includes a plate 136 and a base 138. For example, the plate 136 and the base 138 are attached to a front surface of the door 106 via the fasteners 122, 124, respectively. As shown best in FIG. 3, the plate 136 defines an opening **126*a* and the base 138 defines an opening 126*b*. The openings 126*a*, 126*b* of the plate 136 and the base 138 may substantially align to collectively form the opening 126 of the locking device 114. In other examples, the locking device 114 may include other suitable structures for securing the door 106** in the closed position.

With continued reference to FIG. 3, the plate 136 may be movable. For example, the plate 136 may rotate about the fastener 122. This may assist in allowing the door 106 to move between positions. For instance, the locking device 114 of FIGS. 1-4 includes bars 110, 112 extending along the front surface of the door 106. In particular, the bar 110 extends between a top side and a bottom of the door 106, and the bar 112 extends from the bar 110. The plate 136 and/or the base 138 may include one or more recesses for receiving the bar 112.

Figure 5:
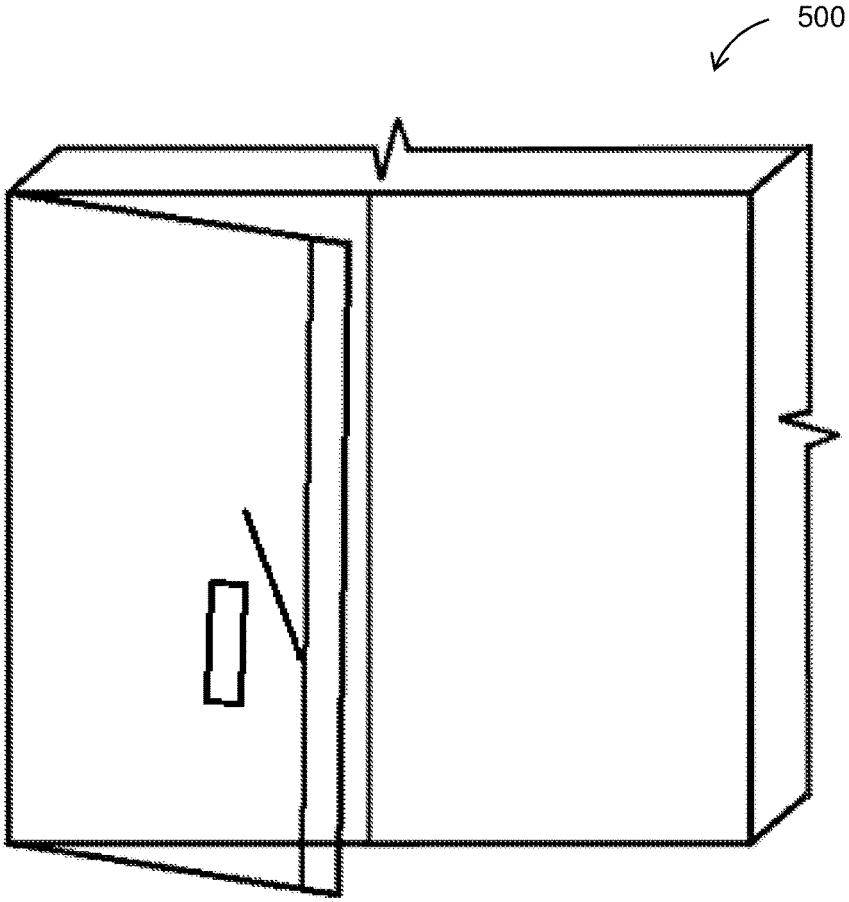
FIG. 5 is a front view of a portion of a shipping container including a door in its open position according to another example embodiment.

If a user wants to secure the door 106, the user may manipulate one or both bars 110, 112 such that the bar 112 extends through, behind, etc. the base 138, as shown best in FIG. 3. The user may then rotate the plate 136 over the bar 112 such that the bar 112 is positioned between the door 106, and the plate 136 and the base 138. During this time, one or both ends of the bar 110 may extend into one or more openings in the floor, ceiling, etc. of the shipping container 100 to restrict movement of the door 106. If the user wants to move the door 106 to its open position, the user may rotate the plate 136 away from the bar 112, and move the bar 112 away from the base 138. After which, the user may open the door 106. For example, FIG. 5 illustrates another shipping container 500 having a door in its open position, as explained above. The shipping container 500 may be substantially the same as the shipping container 100 of FIG. 1, or different. For instance, the shipping container 500 may include the same or different locking device 114 of FIGS. 1-4, the security device 116 of FIG. 4, etc. The shipping container 500 may be a shipping container for a truck, a ship, an airplane, a train, and/or any other suitable cargo hauling device, as further explained below.

Referring back to FIGS. 1-4, the opening 126 (e.g., the openings **126*a*, 126*b*) may be any suitable size and/or shape to accommodate the security device 116. For example, and as shown in FIGS. 2-4, the opening 126 is substantially oval shaped. In other embodiments, the opening 126 may be substantially rectangular shaped, substantially triangular shaped, etc. depending on, for example, the size and/or shape of the security device 116. Additionally, the opening 126 of the locking device 114** may have a width (e.g., a diameter) substantially equal to 1 cm, 2.5 cm, 5 cm, etc.

Each of the fasteners 122, 124 (and/or other fasteners disclosed herein) may be any suitable fastener for attaching the locking device 114 to the door 106. In the particular example of FIGS. 1-4, the fasteners 122, 124 are bolts. In other examples, one or both fasteners 122, 124 may be screws, pins, rivets, etc.

As shown in FIGS. 1-4, the locking device 114, including both fasteners 122, 124, are positioned on the door 106. In other embodiments, at least one of the fasteners 122, 124 may be positioned on another adjacent door, wall, etc. For example, the locking device 114 may be positioned in a horizontal orientation such that one fastener 122 is positioned on the door 106 and the other fastener 124 is positioned on the door 108.

As shown in FIG. 1, the shipping container 100 includes another locking device 118 and bars 140, 142 for securing the door 108 in its closed positioned. The locking device 118 and/or the bars 140, 142 may be and/or function the same or differently than the locking device 114 and the bars 110, 112. In the particular example of FIG. 1, the locking device 118 and the bars 140, 142 are the same as the locking device 114 and the bars 110, 112. As such, the locking device 118 defines an opening for receiving another security device (not shown) if desired. The security device for the locking device 118 may the same or different as the security device 116.

Additionally, although the shipping container 100 of FIG. 1 includes two doors 106, 108, it should be apparent that more or less doors may be employed. For example, the shipping container 100 may include only one back door 106, two back doors 106, 108 and a side door (not shown), etc. In other examples, the one or both doors 106, 108 may slide in a vertical direction, a horizontal direction, etc.

The security devices disclosed herein may be any suitable shape and/or size including those configured to fit through an opening in a locking device and to cover adjacent fasteners, as explained above. For example, and as shown in FIG. 4, the security device 116 includes the wings 128, 130 and a middle portion (e.g., a neck) between the wings 128, 130. As shown, the wing 128 has an elongated elliptical shape and the wing 130 has a substantially square shape.

Additionally, the middle portion of the security device 116 has a width that is smaller than the width of the wings 128, 130. As such, the security device 116 has a substantially hour glass shape. This may ensure the security device 116 fits within the opening 126 but does not slide out of the opening 126 in the locking device 114 when the security device 116 is installed. The width of the middle portion and/or the wings 128, 130 may depend on, for example, the size and/or shape of the opening 126.

In other embodiments, the middle portion and the wings 128, 130 may have a substantially similar (e.g., a uniform) width. In such examples, one or more mechanical fasteners, adhesives, etc. may be used to ensure the security device 116 cannot slide out of the opening 126 in the locking device 114.

Figure 6:
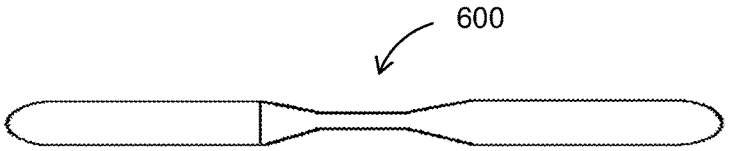
FIG. 6 is a front view of a security device including two elliptical shaped wings according to yet another example embodiment.
Figure 7:
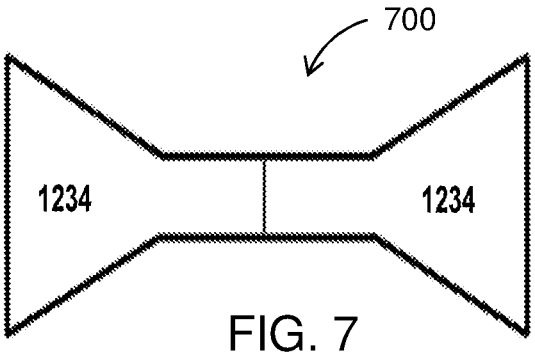
FIG. 7 is a front view of a security device including two triangular shaped wings according to another example embodiment.

Additionally and/or alternatively, other security devices may be used to secure one or both doors 106, 108 of FIG. 1 and/or any other door disclosed herein. For example, FIG. 6 illustrates another security device 600 substantially similar to the security device 116, but where the wings are substantially the same size and shape. Likewise, FIGS. 7-11 illustrate other example security devices 700, 800, 900, 1000, 1100 including a middle portion having a narrower width than the opposing wings.

Additionally, and as explained above, the security devices may be a one piece construction, a two piece construction, etc. For example, the security devices 800, 900 of FIGS. 8 and 9 each are shown as a one-piece construction, and the security devices 116, 600, 700, 1000, 1100 of FIGS. 4, 6, 7, 10 and 11 each are shown as a two-piece construction. In some two-piece construction embodiments, the security device may include two connectors (e.g., bolts, screws, nuts, threaded openings, etc.) for coupling the wings, members, etc. together. For example, the security device 1000 of FIG. 10 includes a male connector and a female connector for coupling the wings, members, etc. together.

Further, the security devices may include an identifier. For example, and as shown in FIGS. 7, 8, 10 and 11, the security devices 700, 800, 1000, 1100 each include an identifier. The identifier can be used to identify a particular cargo, shipping container, etc. For example, the identifier can be compared with another identifier on a bill of lading including the cargo, the shipping container, etc. This comparison may also indicate to the cargo's owner that a security device has not been broken, etc. As shown, the security devices 700, 1000 of FIGS. 7 and 10 include the numeric identifier "1234," the security device 800 of FIG. 8 includes the alphabetic identifier "ABC," and the security device 1100 of FIG. 11 includes the numeric identifier "12" on one wing and the numeric identifier "34" on another wing. In other embodiments, any one of the security devices and/or the wings disclosed herein may include any suitable identifier including one or more alphanumeric characters, bar codes (e.g. linear barcodes, matrix barcodes such as QR codes, etc.), images, etc.

The security devices including the wings may be formed of any suitable material(s). Preferably, the security devices are formed of one or more plastics such as polyethylene terephthalate (PET), polyvinyl chloride (PVC), high-density polyethylene (HDPE), low-density polyethylene (LDPE), etc. In other embodiments, the security devices may be formed of another suitable material including, for example, one or more metals, rubbers, etc. In some embodiments, the security devices may be formed of a combination of materials. For example, the security devices may be formed of a combination of plastic and metal.

Figure 8:
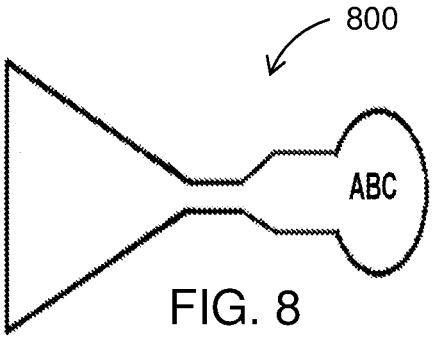
FIG. 8 is a front view of a security device including a triangular shaped wing and a circular shaped wing according to yet another example embodiment.
Figure 9:
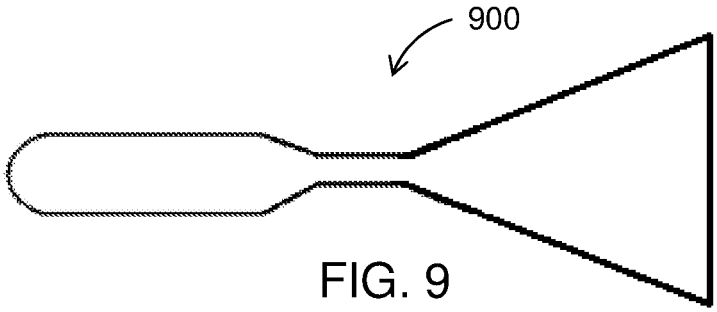
FIG. 9 is a front view of a security device including an elliptical shaped wing and a triangular shaped wing according to another example embodiment.
Figure 10:
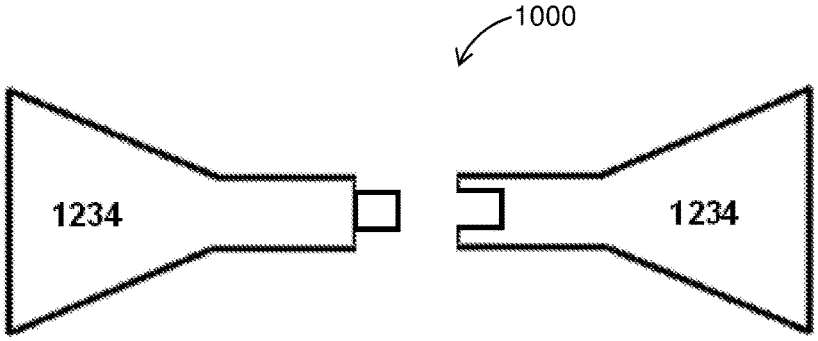
FIG. 10 is a front view of a security device including two members having a female connector and a male connector according to yet another example embodiment.
Figure 11:
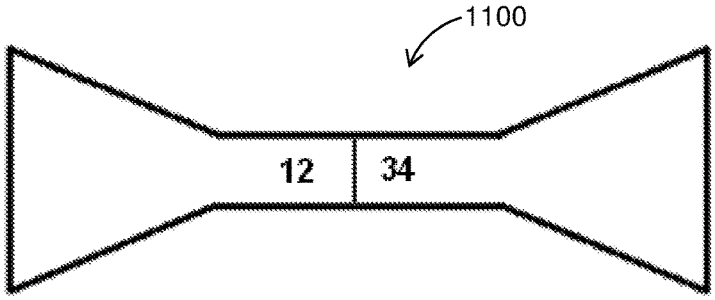
FIG. 11 is a front view of a security device including two triangular shaped wings having a sequential identifier according to another example embodiment.

The wings disclosed herein may be any suitable shape including those shaped and sized to prevent passage through an opening in a locking device and to cover adjacent fasteners, as explained above. For example, the wings may include an elliptical shape as shown in FIGS. 4, 6 and 9, a triangular shape as shown in FIGS. 7-11, a circular shape as shown in FIG. 8, etc.

Further, the wings of a security device each may have the same shape and/or size, as shown in FIGS. 6, 7, 10 and 11. Alternatively, the wings may have different shapes and/or sizes. For example, the security device 800 of FIG. 8 includes a triangular shaped wing and a circular shaped wing, and the security device 900 of FIG. 9 includes an elliptical shaped wing and a triangular shaped wing.

The shipping containers disclosed herein may be used in various different applications. For example, any one of the shipping containers disclosed herein may be a shipping container on a semi-trailer hauled by semi-trailer truck, as shown in FIG. 1. In other embodiments, the shipping containers may be hauled by ships, airplanes, trains, and/or any other suitable cargo hauling device.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A shipping container for storing cargo, the shipping container comprising:

a plurality of walls defining a cargo storing area, one or more doors coupled to at least one of the plurality of walls, at least one door of the one or more doors movable between an open position exposing the cargo storing area and a closed position, a locking device configured to secure said at least one door in its closed positioned, the locking device defining an opening and including a first fastener and a second fastener, at least one of the first fastener and the second fastener attached to said at least one door, and a security device including a neck having a top side, a bottom side and opposing sides defining a width of the neck, the neck insertable through the opening of the locking device, a first wing extending from the top side of the neck and substantially covering the first fastener, and a second wing extending from the bottom side of the neck and substantially covering the second fastener, the first wing including opposing sides defining a width, the second wing including opposing sides defining a width, wherein the width of the neck insertable through the opening of the locking device is smaller than the width of the first wing and the width of the second wing, and wherein the first wing and the second wing are configured to prevent access to the first fastener and the second fastener when the neck of the security device is inserted through the opening of the locking device.

2. The shipping container of claim 1 wherein the first fastener and the second fastener are attached to said at least one door.

3. The shipping container of claim 1 wherein the locking device is a first locking device and wherein the security device is a first security device, the shipping container further comprising a second locking device defining an opening and including a first fastener and a second fastener, and a second security device insertable through the opening of the second locking device, the second security device including a first wing and a second wing opposing the first wing, the first wing substantially covering the first fastener of the second locking device and the second wing substantially covering the second fastener of the second locking device when the second security device is inserted through the opening of the second locking device.

4. The shipping container of claim 1 wherein the security device is formed at least partially of plastic.

5. The shipping container of claim 4 wherein the security device includes an identifier.

6. The shipping container of claim 1 wherein the security device includes a substantially hour glass shape.

7. The shipping container of claim 1 wherein at least one of the first wing and the second wing includes a substantially elliptical shape.

8. The shipping container of claim 1 wherein at least one of the first wing and the second wing includes a substantially circular shape.

9. The shipping container of claim 1 wherein at least one of the first wing and the second wing includes a substantially triangular shape.

10. The shipping container of claim 1 wherein at least one of the first fastener and the second fastener includes a bolt.

11. The shipping container of claim 1 wherein the security device is configured for a single use.

12. The shipping container of claim 11 wherein the security device includes two members coupled together when the security device is inserted through the opening of the locking device.

13. The shipping container of claim 1 wherein the shipping container is positionable on a semi-trailer.

14. A security device for a shipping container including a plurality of walls defining a cargo storing area, one or more doors coupled to at least one of the plurality of walls, at least one door of the one or more doors movable between an open position exposing the cargo storing area and a closed position, and a locking device configured to secure said at least one door in its closed positioned, the locking device defining an opening and including a first fastener and a second fastener, at least one of the first fastener and the second fastener attached to said at least one door, the security device adapted for placement in the opening of the locking device, the security device comprising a neck including a top side, a bottom side and opposing sides defining a width of the neck, the neck insertable through the opening of the locking device, a first wing extending from the top side of the neck, and a second wing extending from the bottom side of the neck, the first wing including opposing sides defining a width, the second wing including opposing sides defining a width, wherein the width of the neck insertable through the opening of the locking device is smaller than the width of the first wing and the width of the second wing, and wherein the first wing and the second wing are adapted to substantially cover the first fastener and the second fastener, respectively, to prevent access to the first fastener and the second fastener when the security device is placed in the opening of the locking device.

15. The security device of claim 14 wherein the first wing or the second wing includes a first connector and the neck includes a second connector corresponding to the first connector.

16. The security device of claim 14 wherein the security device is formed at least partially of plastic.

17. The security device of claim 14 wherein the security device includes an identifier.

18. The security device of claim 14 wherein the security device is configured for a single use.

19. The security device of claim 14 wherein the security device includes a substantially hour glass shape.

20. The security device of claim 14 wherein at least one of the first wing and the second wing includes at least one of a substantially elliptical shape, a substantially circular shape, and a substantially triangular shape.

* * * * *